US005590627A

United States Patent [19]

Rygiel et al.

[11] Patent Number: 5,590,627

[45] Date of Patent: Jan. 7, 1997

[54] FLUID INLETTING AND SUPPORT STRUCTURE FOR A VARIABLE VALVE ASSEMBLY

[75] Inventors: Ronald Rygiel, Prospect Heights, Ill.; Antoni Szatkowski, Windsor, Canada

[73] Assignee: Chrysler Corporation, Auburn Hills, Mich.

[21] Appl. No.: 581,786

[22] Filed: Jan. 2, 1996

[51] Int. Cl.[6] ..... F01L 1/12; F01L 13/00

[52] U.S. Cl. ..... 123/90.16; 123/90.36

[58] Field of Search ..... 123/90.12, 90.15, 123/90.16, 90.17, 90.27, 90.33, 90.36, 90.37, 90.39, 90.44

[56] References Cited

U.S. PATENT DOCUMENTS

| | | | |
|---|---|---|---|
| 4,655,177 | 4/1987 | Wells et al. | 123/90.36 |
| 4,727,830 | 3/1988 | Nagahiro et al. | 123/90.16 |
| 4,759,322 | 7/1988 | Konno | 123/90.16 |
| 4,768,475 | 9/1988 | Ikemura | 123/90.16 |
| 4,777,914 | 10/1988 | Konno | 123/90.4 |
| 4,788,946 | 12/1988 | Inoue et al. | 123/90.16 |
| 4,793,296 | 12/1988 | Inoue et al. | 123/90.16 |
| 4,799,463 | 1/1989 | Konno | 123/90.17 |
| 4,869,214 | 9/1989 | Inoue et al. | 123/90.16 |
| 4,887,563 | 12/1989 | Ishida et al. | 123/90.16 |
| 4,905,639 | 3/1990 | Konno | 123/90.16 |
| 5,031,583 | 7/1991 | Konno | 123/90.16 |
| 5,033,420 | 7/1991 | Matayoshi et al. | 123/90.16 |
| 5,042,437 | 8/1991 | Sakuragi et al. | 123/90.16 |
| 5,085,182 | 2/1992 | Nakamura et al. | 123/90.16 |
| 5,125,373 | 6/1992 | Yamada et al. | 123/90.36 |
| 5,388,552 | 2/1995 | Sugimoto et al. | 123/90.16 |
| 5,394,841 | 3/1995 | Murakami | 123/90.16 |
| 5,515,820 | 5/1996 | Sugimoto et al. | 123/90.16 |

*Primary Examiner*—Weilun Lo
*Attorney, Agent, or Firm*—Kenneth H. MacLean

[57] ABSTRACT

A fluid inletting system for a hydaulically actuated variable valve selection assembly for an engine valve train of an engine cylinder head with dual camshafts and two valves associated with each camshaft per cylinder. The latching mechanisms associated with the rocker arms are activated by pressurized engine lubricating oil which is introduced to the interior of the tubular support shaft for application against the end of the cylindrical portion of the latching member. The support shafts for each cylinder are supported by bosses of the cylinder head and aligned end to end with thin washer or spacer members between the ends of adjacent shafts to define separate oil passages in two adjacent shafts.

5 Claims, 3 Drawing Sheets

FLUID INLETTING AND SUPPORT STRUCTURE FOR A VARIABLE VALVE ASSEMBLY

TECHNICAL FIELD

A valve train actuation mechanism having three rocker arms for each pair of inlet and/or exhaust valves in a dual overhead camshaft, multi-valve type cylinder head. Each cylinder has multiple valves, such as two inlet valves and/or two exhaust valves per cylinder and each pair of valves has three camshaft lobe portions for actuation. An end portion of the three rocker arms are supported about a tubular support shaft which extends between spaced support bosses on the cylinder head and these tubular shafts are aligned end to end for adjacent cylinders. The interior of the tubular support shaft provides a fluid conduit means for pressurized oil from a passage in the cylinder head boss. Each shaft is isolated from the next in line shaft by a partition washer member inserted between abutting ends of adjacent shafts. Selective activation of movable latching means associated with the rocker arms is by application of the pressurized oil to produce different operational modes of the pair of valves.

BACKGROUND OF THE INVENTION

A simple variable lift and/or timing valving arrangement for a twin intake (and/or exhaust) valved engine has long been desirable. At idle and relatively low loads, it is desirable to move the valves to a relatively low opened position (low lift) and for a relatively short duration for increasing the flow velocity of air entering a cylinder. This promotes a thorough mixing of air and fuel and provides a more complete combustion. At mid-level engine speeds with moderate loading, an increased opening (lift) of the valves and/or a longer opening duration is desirable to adequately meet the air and fuel needs of the engine. At greater engine speeds and/or greater loading of the engine, increased opening or lift of the valves and/or opening duration is desirable. At wide open throttle, it is desirable to increase again the opening of the valves and increase the opening duration to provide maximum power for the engine.

A preexamination patent search of the subject valve train arrangement uncovered U.S. patents: U.S. Pat. No. 4,727,830 to Nagahiro et. al.; U.S. Pat. No. 4,759,322 to Konno; U.S. Pat. No. 4,777,914 to Konno; U.S. Pat. No. 4,788,946 to Inoue et. al.; U.S. Pat. No. 4,793,296 to Inoue et. al.; U.S. Pat. No. 4,869,214 to Inoue et. al.; U.S. Pat. No. 4,887,563 to Ishida et. al.; U.S. Pat. No. 4,905,639 to Konno; and U.S. Pat. No. 5,031,583 to Konno which disclose valve train arrangements with modes of operation using three rocker arms arranged side by side and a camshaft with three lobes for each cylinder. The rocker arm located between two end rocker arms houses a pair of pistons within bores formed through each of its side surfaces which face the other rocker arms. A bore in the other rocker arms receives a piston which is selectively moveable out from the bore of the middle rocker arm. A pair of passages in the middle rocker arm selectively pressurize a space behind each of the pistons to cause movement of the piston. The U.S. Pat. No. 4,799,463 is similar to the above described patents except that four rocker arms are provided rather than three.

U.S. Pat. No. 4,768,475 to Ikemura discloses a valve train mechanism for a single intake valve type cylinder head utilizing a pair of rocker arms activated by a two lobed per cylinder camshaft. Multiple pins within aligned bores formed in one of the rocker arms and in an actuating arm are selectively moved to link the members together.

U.S. Pat. No. 5,033,420 to Matayoshi et. al. discloses a valve structure including pivots formed in the cylinder head and a hydraulic fluid supply passage to said pivot with an adjustment screw and passage therein.

U.S. Pat. No. 5,042,437 to Sakuragi discloses a valve train arrangement with a single rocker arm supporting several cam follower which are selectively retractable away from a respective cam lobe.

SUMMARY OF THE INVENTION

The subject variable valve actuation mechanism (variable timing, duration, and/or lift) is for a valve train of an internal combustion engine with dual overhead camshafts and having a pair of intake and/or exhaust valves per cylinder. Each cylinder has three eccentric camshaft lobes and three rocker arms associated with each pair of valves. A tubular shaft supports the three rocker arms in a side by side relationship to one another for pivotal movements as each is engaged by one if the three cam lobes. The three rocker arms are arranged in side by side relationship to one another to define two end rocker arms and one middle rocker arm.

A hydraulically powered latching mechanism is housed in each of the end rocker arms for selectively connecting an end rocker arm with the middle rocker arm. Preferably, a camshaft lobe which engages one end rocker arm has a profile which produces a relatively low lift and/or short opening duration valve actuation. Another camshaft lobe engages the other end rocker arm and preferably has a profile which produces a greater lift and/or longer opening duration valve actuation. Finally, the third camshaft lobe engages the middle rocker arm and preferably has a profile which produces a still greater lift and/or opening duration valve actuation.

The subject valve train includes hydraulically powered rocker arm latching mechanism to selectively lock an end rocker arm with the middle rocker arm so that the valve actuation through the end rocker arm is produced by the third cam lobe which engages the middle rocker arm. The mechanism consists of a movable latch or locking member which is normally housed within an end rocker arm. Specifically, the latching member has a cylindrical portion which is reciprocally mounted in the hollow interior of a shaft which also the supports the rocker arms. Another portion of the latching member forms a relatively thin, flat blade-like portion which extends radially away from the cylindrical portion and through a slot formed in the wall of the hollow support shaft. The blade portion extends into a pocket or cavity formed in an associated end rocker arm. The slot's width in a circumferential direction of the shaft is sufficient to allow pivotal movements of the associated rocker arm caused by actuation by a lobe of the camshaft and movement of the blade which extends through the slot. The middle rocker arm has a channel formed therein with a cross-sectional configuration conforming to the cross-section of the blade as well as the cross-section of the pockets in the end rocker arms. The slot's length in the axial direction of the shaft permits movements of the latch member from one position where the blade is wholly within the pocket of an end rocker arm to a second position where the blade is partly in a pocket and partly in a portion of the adjacent channel formed in the middle rocker arm. Resultantly, the latching member can be moved from its normal rest position into an active position partly in an adjacent middle rocker arm. Various combinations of positioning the latching members relative to the middle rocker arm provides four modes of operation.

The movement of each of the latching members and the resultant operational modes of the valve train mechanism as described above are controlled by selective application(s) of hydraulic fluid pressure against outer end(s) of the cylindrical portion of the latching member(s). When no pressure is exerted on the outer ends, the latching members are in a rest position established by a spring. Specifically, opposite ends of a light coil spring engage inner ends of the two cylindrical portions to maintain the latching members within their respective end rocker arm pockets. When pressurized hydraulic fluid such as lubricating oil is applied to the outer end of a cylindrical portion, the resultant force thereon causes the latching member to be urged towards the middle rocker arm. When the pocket of the end rocker arm pivots relative to the channel of the middle rocker arm, the blade of the latching member will enter the channel. This locks the two rocker arms together for common pivotal actuation produced by the higher lift cam profile associated with the middle rocker arm. Withdrawal of the pressurized oil allows the pressure to fall due to leakage and consequently the blade exists the channel and retreats to the pocket of an end rocker arm.

The latching mechanisms associated with the rocker arms are activated by pressurized engine lubricating oil which is introduced to the interior of the tubular support shaft for application against the end of the cylindrical portion of the latching member. The support shafts for each cylinder are supported by bosses of the cylinder head and aligned end to end with thin washer or spacer members between the ends of adjacent shafts to define separate oil passages in two adjacent shafts.

DESCRIPTION OF EMBODIMENT SHOWN IN THE DRAWINGS

Figure 1:
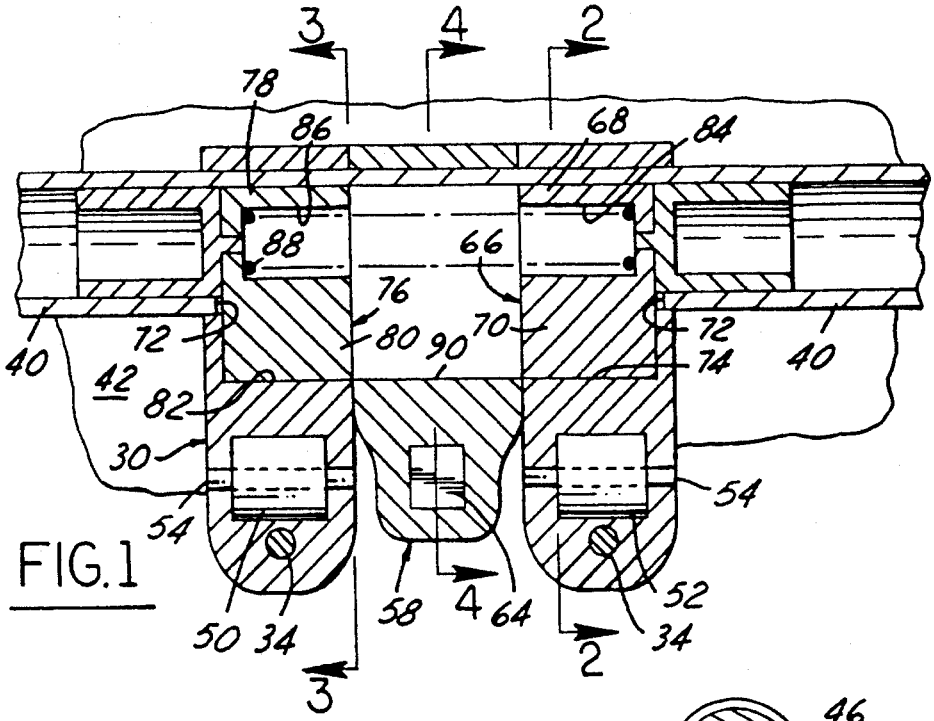
FIG. 1 is a top planar sectional view of a portion of a valve train associated with a single cylinder of a dual intake valve engine and in a first mode of operation.
Figure 2:
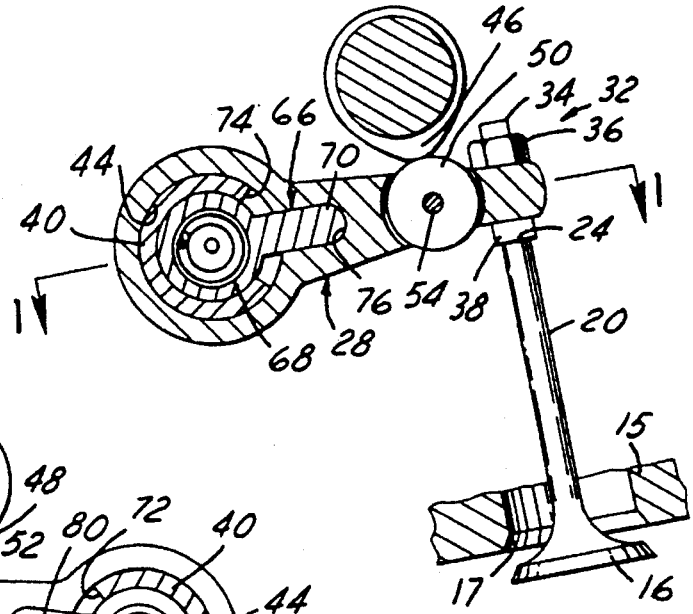
FIG. 2 is a side elevational and sectioned view of the valve train taken along section line 2—2 in FIG. 1 and looking in the direction of the arrows.
Figure 3:
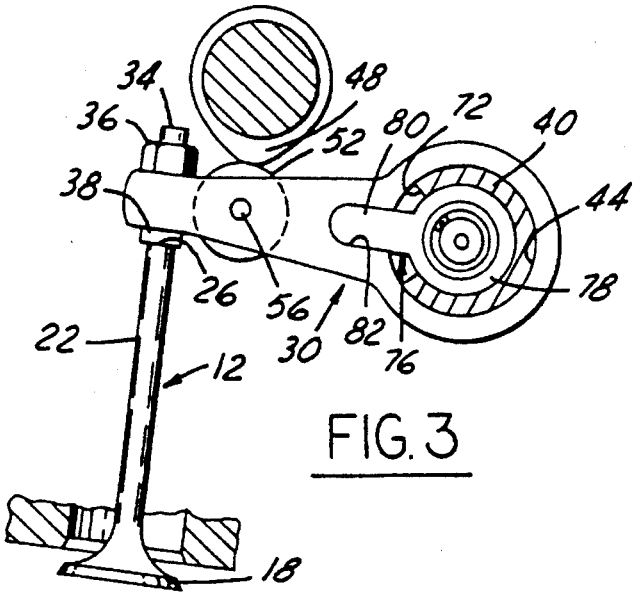
FIG. 3 is a view like FIG. 2 but taken along section line 3—3 in FIG. 1.

Turning now to FIGS. 1 and 2, shown is a portion of an engine valve train for a single cylinder of a dual intake valve type cylinder. One of the two intake valves 10 is visible in FIG. 2 and the other of the two intake valves 12 is visible in FIG. 3. Both valves are of the poppet type commonly used in internal combustion engines. Specifically, the valves 10, 14 each has an enlarged head portions 16, 18 respectively. As best seen in FIGS. 2 and 3, the cylinder head 15 forms a valve seat 17 against which the head portions 16, 18 seat when the valves are closed. The valves 10, 12 each has an elongated stem portion 20, 22 respectively. The stem portions 20, 22 each terminate at an upper end 24, 26 respectively.

The upper ends 24, 26 of valves 10, 14 are engaged by portions of respective rocker arms 28, 30. More specifically, each rocker arm carries an adjustable valve lash mechanism 32. The mechanism 32 includes a threaded shaft 34 and a locking nut 36 which coact to position a head portion 38 of shaft 34 against the upper ends of the valves. This type of lash adjustment mechanism is relatively common in engine design when it is desirable to selectively set a predetermined clearance between the position of the rocker arm and the end of the valve. Such a spacing is desired to accommodate thermal growth of the components as the engine achieves a working temperature. In particular, the elongated valves 10, 14 are subject to significant thermal growth.

Referring again to FIG. 1, a hollow support shaft 40 extends parallel to the top surface 42 of a cylinder head. The support shaft 40 extends through cylindrical bores 44 in the rocker arms 28, 30 as best shown in FIGS. 2 and 3. The bores 44 permit the rocker arms to rotate or pivot about the support shaft 40. Clockwise pivotal motion of the rocker arms 28 in FIG. 2 and counterclockwise pivotal motion of the rocker arm 30 in FIG. 3 is caused by the action of camshaft lobes 46 and 48, respectively, against roller followers 50, 52 carried by the rocker arms as shown in FIGS. 2 and 3. Specifically, the roller followers 50 and 52 are supported on shafts 54, 56. As will be explained further hereinafter, the camshafts lobes 46, 48 are not of equal eccentricity. Specifically, the lobe portion 46 adapted to cooperate with rocker arm 28 is less severe than the lobe portion 48 which is adapted to cooperate with rocker arm 30.

It should be noted that a force tending to move rocker arm 28 in a counterclockwise direction in FIG. 2 and a force tending to move the rocker arm 30 in a clockwise direction in FIG. 3 are produced by valve springs (not shown). These valve springs are commonly used to close poppet type valves in an internal combustion engine and are usually positioned about the stem portions 20, 22.

As so far described, the engine valve train is capable of operating valves 10, 12 when rotation of the camshaft causes lobes 46, 48 to move over the roller followers 50, 52. This represents a first mode of valve train operation in which valve 10 is opened to a predetermined low lift or opening and valve 12 is opened to a predetermined higher lift or opening.

Figure 4:
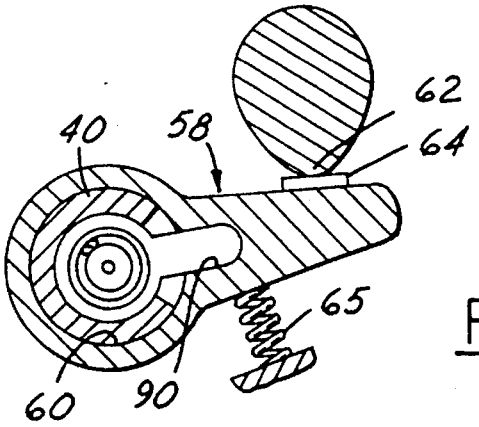
FIG. 4 is a view like FIG. 2 but taken along section line 4—4 in FIG. 1.

As previously noted, this valve train is configured to selectively provide three additional modes of operation. Referring back to FIG. 1, a third rocker arm 58 is supported by shaft 40 in between the other two rocker arms 28, 30. Like rocker arms 28 and 30, the third rocker arm 58 has a cylindrical bore 60 which is adapted to encircle shaft 40. Unlike the other rocker arms, it does not contact an intake valve. As shown in FIG. 4, a camshaft lobe 62 engages the rocker arm 58 which tending to rotate or pivot the arm in a clockwise direction. Specifically, the lobe 62 engages a wear pad 64 mounted upon the arm 58. The wear pad 64 is of hardened material so as to provide long life. Also, a spring 65 (shown somewhat schematically) yieldably urges the rocker arm 58 in a counterclockwise direction in FIG. 4 against the effect of cam lobe 62.

Referring again to FIGS. 1 and 2, a locking or latching member 66 includes a cylindrical portion 68 within the interior of support shaft 40. A thin, flat bar portion 70 extends radially from portion 68 through an elongated slot 72 formed in shaft 40. The bar portion 70 extends into a similarly configured pocket 74 formed within rocker arm 28. As seen in FIG. 2, the slot 72 is wide enough in the circumferential direction to allow the latching member to pivot with the rocker arm 28 and without interference with shaft 40.

Referring now to FIGS. 1 and 3, a locking or latching member 76 includes a cylindrical portion 78 within the interior of support shaft 40. A thin, flat bar portion 80 extends radially from the cylindrical portion 78 through the elongated slot 72 formed in shaft 40. The bar portion 80 extends into a similarly configured pocket 82 formed within the rocker arm 30. As best seen in FIG. 3, the slot 72 is wide enough in the circumferential direction to allow the latching member to pivot with the rocker arm 28 and without interference with shaft 40.

THE FOUR OPERATIONAL MODES

First Operational Mode

Referring to FIG. 1, cylindrical portion 68 of latching member 66 has a counterbore 84 formed therein. Likewise, cylindrical portion 78 of latching member 76 has a counterbore 86 formed therein. Opposite ends of an elongated coil spring 88 seat in respective counterbores 84, 86 to produce a yieldably force urging the latching members 66 and 78 away from one another and into pockets 74 and 82 of rocker arms 66, 76. In this position, the engagement of cam lobes 46, 48 with a respective rocker arm 28, 30 directly activates a respective valve 10 and 12.

Second Operational Mode

A channel 90 that has the same cross-sectional configuration of the pockets 76 and 82 is formed in the third or middle rocker arm 58. As seen from FIG. 1, in a common position of the three rocker arms, the pockets 76, 82 are aligned with the channel 90. In this position, either or both of the latching members 66, 78 are able to move partially out of their respective pockets and into the channel. When a latching member is within the channel 90, the action of the cam lobe 62 associated with the middle arm 58 controls the pivoting of that rocker arm.

Figure 5:
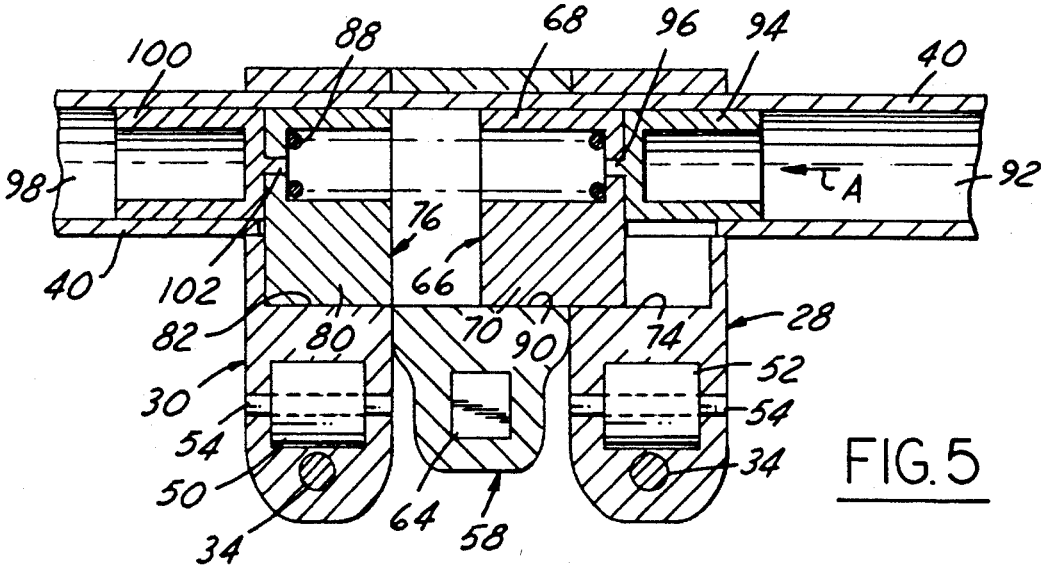
FIG. 5 is a view like FIG. 1 but in a second mode of operation.

The latching member 66 is moved to the left against the force of spring 88 to the position shown in FIG. 5 in response to a Force A. This force is selectively produced by routing pressurized fluid such as lubricating oil to the interior 92 of hollow shaft 40. A cup shaped piston 94 is attached by tab 96 to the cylindrical portion 68 of member 66 to direct the leftward movement of the member 66. Bar portion is then within both the pocket 74 and channel 90 which locks the arms 28 and 58 together for common pivotal movements.

Third Operational Mode

Figure 6:
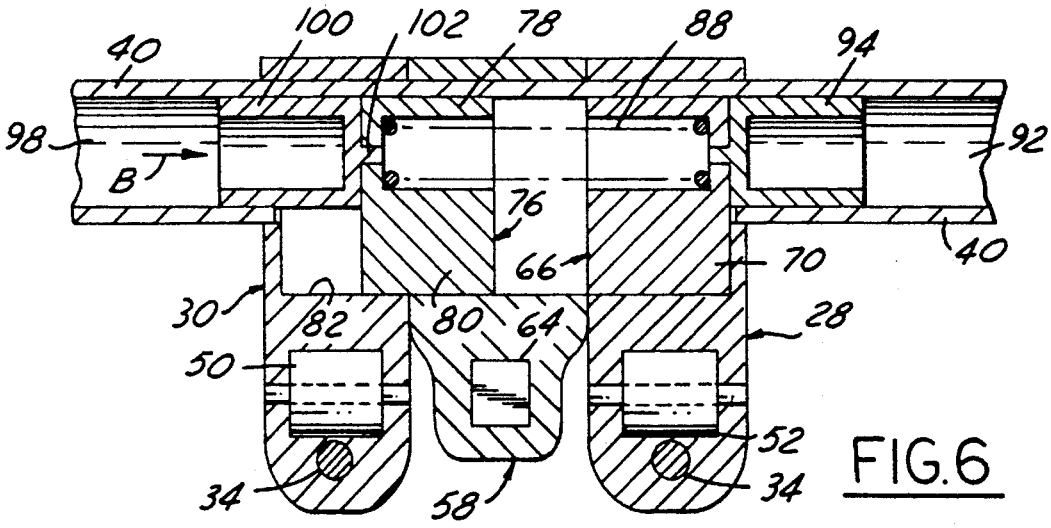
FIG. 6 is a view like FIG. 1 but in a third mode of operation.

Like the movement of member 66, latching member 76 is moved to the right in FIG. 1 against the force of spring 88 to the position shown in FIG. 6 in response to a Force B. This Force B is selectively produced by routing pressurized fluid such as lubricating oil to the interior 98 of hollow shaft 40. A cup shaped piston 100 is attached by tab 102 to the cylindrical portion 78 of member 76 to direct the rightward movement of the member 76. Bar portion 80 is then within both the pocket 82 and channel 90 which locks the arms 30 and 58 together for common pivotal movements.

Fourth Operational Mode

Figure 7:
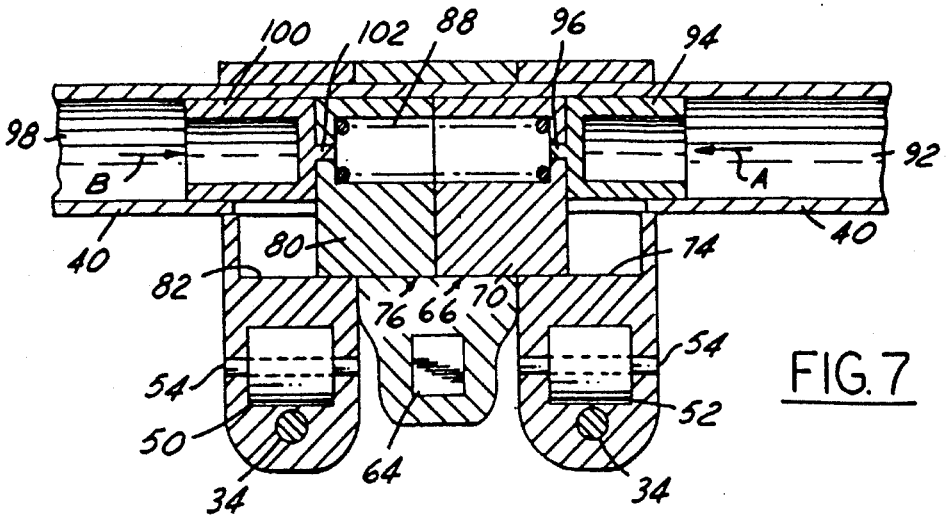
FIG. 7 is a view like FIG. 1 but in a forth mode of operation.

By simultaneously pressurizing both interiors 92 and 98 of shaft 40, the latching member 66 is moved to the left and latching member 76 is moved to the right from respective rest positions shown in FIG. 1 to latching positions shown in FIG. 7. In this mode, the bars 70 and 80 are both within their pockets 74, 82 and within the channel 90. Thus, the rocker arms 28 and 30 are both locked into movement with the rocker arm 58. Because the degree of eccentricity of the cam lobe 62 is greater than lobes 46 or 48, that lobe controls the lift and timing effects on the valves 10 and 12.

Figure 8:
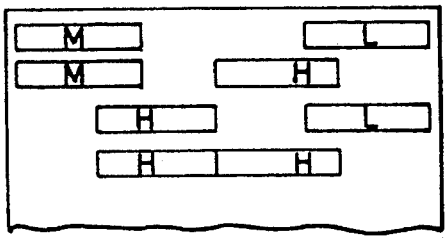
FIG. 8 is a somewhat schematic view showing placements parts of the valve train in four modes of operation.

The four modes of operation are best shown in FIG. 8 which indicates the position of the bars relative to the channel in the middle rocker arm. In a first mode, the low lift cam lobe directly controls valve 10 and the medium lift cam lobe directly controls valve 12. In a second mode, the low lift cam lobe directly controls valve 10 and the high lift cam lobe associated with the middle rocker arm indirectly controls valve 12 via the latching mechanism. In a third mode, the high lift cam lobe associated with the middle rocker arm indirectly controls valve 10 and the medium lift cam lobe directly controls valve 12. In a forth mode, the high lift cam lobe associated with the middle rocker arm indirectly controls both valves 10 and 12 via the latching mechanism.

Figure 9:
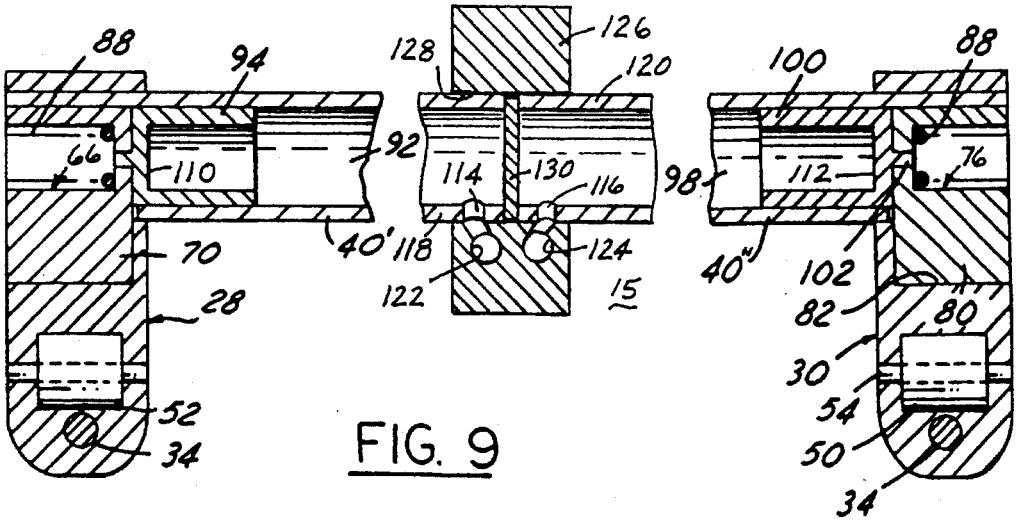
FIG. 9 is a top planar sectional view of a portion of a valve train similar to FIGS. 1, 5–7 but associated with components of two adjacent cylinders showing the oil input for the valve actuation components.

FIG. 9 is a top view of a portion of the valve train. Unlike FIGS. 1, and 5–7 which show the portion of the valve train associated with or over a singe cylinder, this view shows the portion over two adjacent cylinders. Specifically, the rocker arm 28 on the left is associated with one engine cylinder. Likewise, the rocker arm 30 on the right is associated with a second adjacent cylinder. It should be appreciated that the remaining two rocker arms associated with the rocker arm 28 and with the rocker arm 30 are of course present but not shown in FIG. 9. Also, components previously described and shown in the other views are numbered the same.

The latch mechanism 66 associated with rocker arm 28 includes the cylindrical part 94 and blade portion 70. When actuation of the mechanism 66 is desired, the outer end 110 of cylindrical portion 94 is exposed to pressurized oil of the engine. This pressurized oil is applied to the interior space 92 of the support shaft 40'.

Likewise in FIG. 9, the latch mechanism 76 associated with rocker arm 30 includes the cylindrical part 100 and blade portion 80. When actuation of the mechanism 76 is desired, the outer end 112 of cylindrical portion 100 is exposed to pressurized oil of the engine. This pressurized oil is applied to the interior space 98 of the support shaft 40".

The pressurized oil is introduced into shaft interiors 92 and 98 through inlet apertures 114 and 116 through end portions 118, 120 of shafts 40' and 40" respectively. In turn, the inlets 114, 116 are feed oil from passages 122, 124 formed in an outwardly projecting portion or boss 126 of cylinder head 15. A similar boss is provided between each of the engine's cylinders and at the ends of the cylinder head as is known in the engine art. A common bearing journal 128 formed by boss 122 supports the end portions 118, 120 of adjacent support shafts 40' and 40" which are aligned in an axial direction as best shown in FIG. 9.

The interiors 92 and 98 of tubular shafts 40' and 40" are separated by a disc shaped washer-like member 130 which is supported between the shaft's ends 118, 120. Because of this separation, pressurized oil can be introduced into space 92 through inlet 114 to activate the latch mechanism 66 without influencing the latch mechanism 76, for example. Likewise, independent activation of latch mechanism 76 can be accomplished by pressurization of space 98 independently of space 92.

While a preferred embodiment and methodology of the invention has been shown and described, other embodiments will now become apparent to those skilled in the art. Accordingly, this invention is not to be limited to that which is shown and described but by the following claims.

We claim:

1. In a hydraulically activated variable valve timing and lift mechanism for a dual overhead camshaft type engine cylinder head having two valves per cylinder associated with each camshaft, an oil pressurization system to activate the mechanism comprising: a tubular shaft associated with each cylinder extending substantially parallel in an axial direction of an associated camshaft with adjacent shafts for side by side cylinders aligned in the axial direction; a boss projecting outward from the cylinder head forming a journal for supporting adjacent end portions of two shafts; means located within said boss and between said pair of end portions to separate the interiors of said adjacent shafts; fluid inletting means formed in said cylinder head boss and through each of said shaft's end portions for selective introduction of pressurized fluid into the shaft interior wherein both of said interiors of adjacent shafts can be independently pressurized.

2. The system as set forth in claim 1 in which said inletting means for the interiors of adjacent shafts includes two separate passages in said cylinder head boss each fluidly connected to a radially extending aperture in each of said end portions.

3. The system as set forth in claim 1 in which said separation means is in the form of a thin washer-shaped disc engaged between the end portions of a pair of adjacent shafts and within said cylinder head boss.

4. In a hydraulically activated variable valve timing and lift mechanism for a dual overhead camshaft type engine cylinder head having two valves per cylinder associated with each camshaft, an oil inletting and pressurization system to activate the mechanism comprising: a tubular shaft associated with each cylinder extending substantially parallel in an axial direction of an associated camshaft with adjacent shafts for side by side cylinders aligned in the axial direction; the cylinder head having bosses which project outwardly and each form a journal for supporting side by side end portions of two adjacent shafts; a washer-like disc positioned within said boss and sandwiched between the end portions of adjacent shafts for separating interiors of these adjacent shafts; a first and a second fluid inletting means formed in said cylinder head boss and through each of said shaft's end portions to selectively introduce pressurized fluid into an interior of said shaft wherein said interiors of adjacent shafts are independently pressurized.

5. The system as set forth in claim 4 in which said inletting means for the interiors of adjacent shafts includes two separate passages in said cylinder head boss each fluidly connected to a radially extending aperture in each of said end portions.

* * * * *